US007990076B2

(12) United States Patent
Van Der Veen et al.

(10) Patent No.: US 7,990,076 B2
(45) Date of Patent: Aug. 2, 2011

(54) LAMP DRIVER CIRCUIT AND METHOD FOR DRIVING A DISCHARGE LAMP

(75) Inventors: Geert Willem Van Der Veen, Eindhoven (NL); Roger Peter Anna Delnoij, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 321 days.

(21) Appl. No.: 12/439,697

(22) PCT Filed: Sep. 4, 2007

(86) PCT No.: PCT/IB2007/053549

§ 371 (c)(1),
(2), (4) Date: Mar. 3, 2009

(87) PCT Pub. No.: WO2008/029344

PCT Pub. Date: Mar. 13, 2008

(65) Prior Publication Data

US 2010/0052557 A1 Mar. 4, 2010

(30) Foreign Application Priority Data

Sep. 7, 2006 (EP) ..... 06120289

(51) Int. Cl.
*H05B 37/02* (2006.01)

(52) U.S. Cl. ..... 315/307; 315/224; 315/308

(58) Field of Classification Search ..... 315/219, 315/291, 307, 308, 224, 223, DIG. 5, DIG. 7
See application file for complete search history.

(56) References Cited

U.S. PATENT DOCUMENTS

| | | | | |
|---|---|---|---|---|
| 6,100,647 | A * | 8/2000 | Giannopoulos et al. | 315/224 |
| 7,291,990 | B2 * | 11/2007 | Ichikawa et al. | 315/291 |
| 2004/0239262 | A1 | 12/2004 | Ido et al. | |
| 2005/0093459 | A1 | 5/2005 | Kishinevsky | |
| 2006/0017388 | A1 | 1/2006 | Stevenson | |

FOREIGN PATENT DOCUMENTS

| | | | |
|---|---|---|---|
| DE | 19708791 | A1 | 9/1998 |
| EP | 0482705 | A2 | 4/1992 |
| WO | 9839950 | A1 | 9/1998 |

* cited by examiner

*Primary Examiner* — David Hung Vu

(57) ABSTRACT

A lamp driver circuit (400) comprises a feedback circuit for controlling stable operation of a discharge lamp (La), e.g. an inductively coupled discharge lamp such as a molecular radiation lamp, and for controlling a light output level of the discharge lamp (La). In particular, if the discharge lamp (La) is operated at a dimmed light output level, the light output is sensitive to changes in the lamp voltage ($V_{La}$), possibly resulting in flickering. In order to control stable lamp operation and prevent flickering, a high-sp feedback circuit is provided for controlling an operating frequency. In order to provide a relatively large dimming range for controlling the light output level, a low-speed feedback circuit is provided for controlling a DC supply voltage level ($V_{DC}$).

8 Claims, 5 Drawing Sheets

LAMP DRIVER CIRCUIT AND METHOD FOR DRIVING A DISCHARGE LAMP

FIELD OF THE INVENTION

The present invention relates to a lamp driver circuit and a method of driving a discharge lamp. In particular, the present invention is suitable to be employed for driving a discharge lamp exhibiting steep impedance changes as a function of lamp voltage.

BACKGROUND OF THE INVENTION

It is known in the art to operate a discharge lamp using an open-loop lamp driver circuit. The lamp driver circuit comprises an inverter circuit for generating a suitable AC current for driving the lamp. Such an open-loop driver circuit may be calibrated during manufacturing with respect to the output power.

A known discharge lamp, e.g. an inductively coupled discharge lamp such as a molecular radiation lamp, may exhibit a steep relation between an output power and a voltage over the lamp terminals. The lamp voltage depends, inter alia, on a frequency of the supplied AC current, the output power thereby being depended on the frequency of the supplied AC current. Further, during run-up the impedance of the lamp may exhibit steep changes. Thus, an open-loop lamp driver circuit may not be suitable for driving such a discharge lamp, since the open-loop lamp driver circuit cannot ensure stable operation of the lamp.

Further, it may be desirable to control the lamp power during run-up and steady-state operation. Due to the above-mentioned steep relations, an open-loop lamp driver circuit may not be suitable for regulating the output power.

It is known to use a feedback circuit, and thus a closed-loop lamp driver circuit for driving a discharge lamp. For example, the frequency of the AC current may be controlled in response to an actual lamp power. However, due to EMI regulations, the frequency range for control may be limited, not allowing both controlling stability and regulating power, in particular not during run-up and for dimming.

Another possibility is to control the DC voltage from which the AC current is generated by the inverter circuit. However, due to the presence of a relative large capacitance for energy buffering at the DC-voltage bus, such a control system is relatively slow, whereas a relatively fast control is required for stability control.

OBJECT OF THE INVENTION

It is desirable to provide a method and circuit for operating a discharge lamp exhibiting steep impedance changes, which method and circuit are suitable to both control the stability and to control the power over a relatively large range.

SUMMARY OF THE INVENTION

The object is achieved in a lamp driver circuit according to claim 1 and in a method for operating a discharge lamp according to claim 7.

According to the invention a feedback circuit is provided comprising a high-speed feedback circuit part and a low-speed feedback circuit part. In response to a difference between a determined actual lamp power and a set lamp power, i.e. a predetermined or selected lamp power, both the frequency and the DC voltage are controlled. The frequency is controlled in order to maintain stability during operation, since the frequency may be adjusted in a relatively short time. The DC voltage is adjusted in order to allow the discharge lamp to be operated in a relatively large power range.

In an embodiment, the actual lamp power sensing circuit comprises a resistor connected to the inverter circuit of the lamp driver circuit. An inverter current flowing through the inverter circuit may be employed as a measure for the actual lamp power, since the inverter current is proportional to the actual lamp power, in particular, the inverter current is substantially equal to the actual lamp power divided by the DC supply voltage.

In an embodiment, the high-speed feedback circuit comprises a voltage controlled oscillator (VCO) configured to receive a voltage signal representing the power difference in order to convert the power difference in a suitable operating frequency.

In an embodiment, the low-speed feedback circuit is configured to receive a set frequency, i.e. a predetermined or selected frequency. Further, the low-speed feedback circuit is configured to determine the operating frequency and to control the DC supply voltage in response to a frequency difference between the operating frequency and the set frequency. In response, the high-speed feedback circuit may adjust the operating frequency towards the set frequency. Thus, a course and fine control method is obtained, thereby preventing interference between the high-speed and the low-speed feedback circuit. As the bandwidth of the high-speed feedback circuit is substantially higher than the bandwidth of the low-speed feedback circuit, the high-speed feedback circuit will track the DC supply voltage changes of the low-speed feedback circuit. Hence, the high-speed feedback circuit is dominant over the low-speed feedback circuit.

BRIEF DESCRIPTION OF THE DRAWINGS

Hereinafter, the present invention is elucidated with reference to non-limiting embodiments as illustrated in the appended drawings, in which.

DETAILED DESCRIPTION OF EXAMPLES

Figure 1:
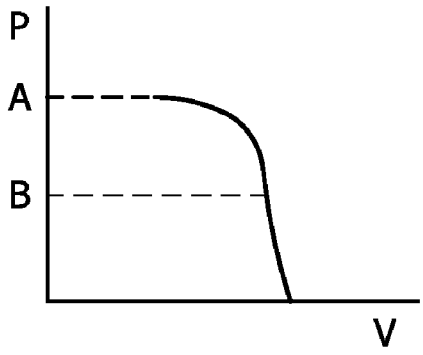
FIG. 1 shows a diagram illustrating a relation between a lamp voltage and a lamp power of a discharge lamp.

Hereinafter, same reference numerals refer to similar elements.

FIG. 1 shows a diagram illustrating a relation between a lamp voltage V (at the horizontal axis) and a lamp power P (at the vertical axis) of a discharge lamp, in particular an inductively coupled discharge lamp, such as a molecular radiation lamp. The lamp voltage V is the voltage over the lamp terminals during lamp operation. At a lamp power level A, the lamp voltage V may vary without directly influencing the lamp power P, since the shown curve is substantially flat. So, the discharge lamp may be stably operated at power level A.

If the discharge lamp is to be operated at a different power level, e.g. power level B, due to the steep relation between the lamp voltage V and the lamp power P, a feedback circuit is required in the lamp driver circuit in order to maintain stable operation.

Figure 2A:
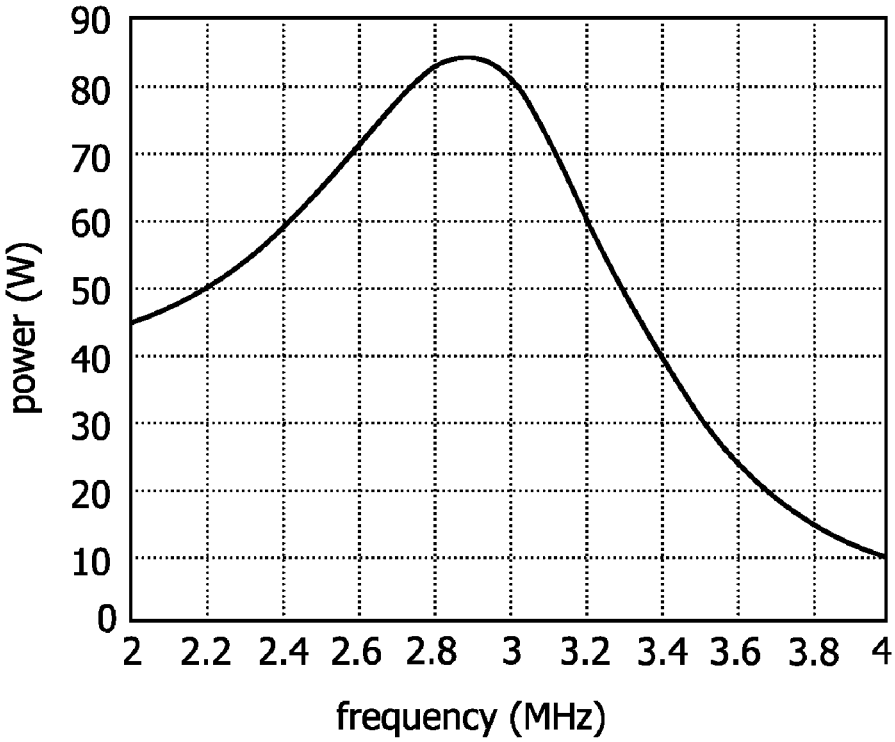
FIG. 2A shows a diagram illustrating a relation between a lamp current frequency and a lamp power of a discharge lamp.
Figure 2B:
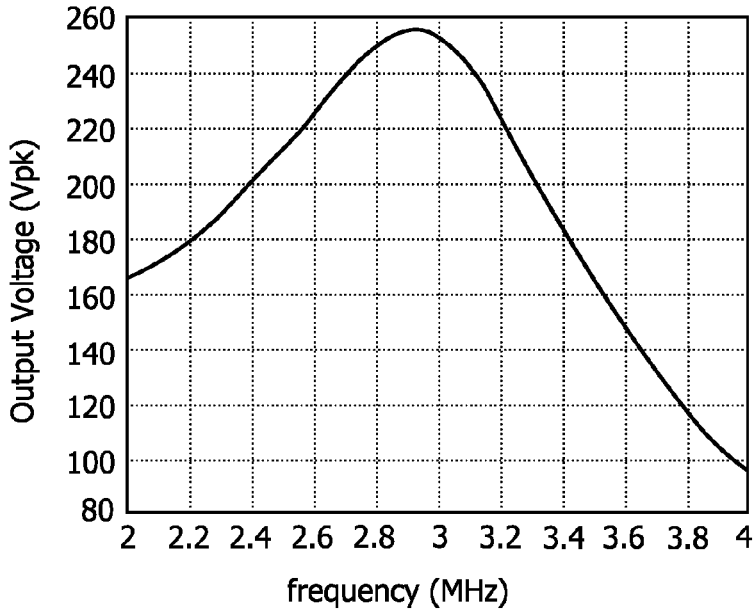
FIG. 2B shows a diagram illustrating a relation between a lamp current frequency and a lamp voltage of a discharge lamp.

The feedback circuit may control a frequency of an AC current supplied to the lamp, as is known in the art. FIG. 2A shows a diagram illustrating a relation between a frequency of the AC lamp current (at the horizontal axis) and a lamp power (at the vertical axis). From the illustrated curve, it is apparent that a maximum lamp power is obtained at a current frequency of about 2.9 MHz. FIG. 2B shows a diagram illustrating a relation between the frequency of the AC lamp current (at the horizontal axis) and a lamp voltage (at the vertical axis). The curve shown in FIG. 2B is substantially equal to the curve shown in FIG. 2A, a maximum lamp voltage being obtained at a lamp current frequency of about 2.9 MHz.

Figure 3:
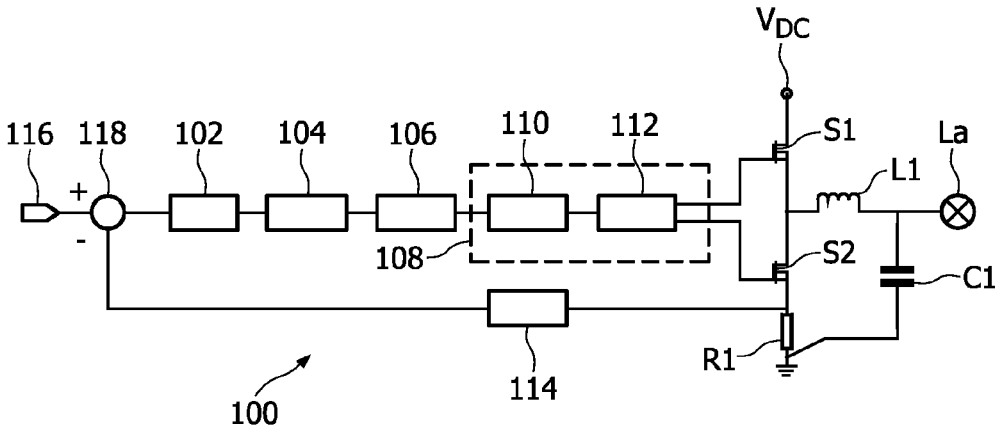
FIG. 3 schematically shows an embodiment of a lamp driver circuit comprising a high-speed feedback circuit.

FIG. 3 illustrates an embodiment of a lamp driver circuit 100 comprising a suitable feedback circuit for controlling a frequency of the lamp current. The lamp driver circuit is connected to a lamp La. An inverter circuit comprises two switching elements S1 and S2 connected in a half-bridge topology. An inductor L1 and a capacitor C1 are connected to an output node of the inverter circuit. The inverter circuit, the inductor L1 and the capacitor C1 are operable to generate a suitable AC lamp current to be supplied to the lamp La. It is noted that the circuit is illustrated schematically and may in practice comprise further elements and connections.

The inverter circuit, and in particular the two switching elements S1 and S2 are connected to an inverter driver circuit 108. The driver circuit 108 is connected to a timing generator 106. The inverter driver circuit 108 may comprise a level shifter 110 and an on/off-control circuit. The timing generator 106 and the inverter driver circuit are operable to generate suitable control signals for controlling on/off switching of the switching elements S1, S2 of the inverter circuit.

The timing generator 106 is connected to a voltage controlled oscillator (VCO) 104. The VCO is connected to a first PI-controller 102. The first PI-controller 102 is connected to a comparator 118. The comparator 118 is further connected to a power setting element 116. The power setting element 116 supplies a set lamp power signal to the comparator 118 in response to a set lamp power, i.e. a predetermined or user-selected lamp power level.

The comparator 118 further receives an actual lamp power signal indicative of an actual lamp power. In the illustrated embodiment of FIG. 3, a resistor R1 is connected in series with the inverter circuit and an inverter current flowing through the inverter flows as well through the resistor R1. Hence, a resistor voltage is generated at a terminal of the resistor R1. The resistor voltage is proportional to the actual lamp power, since the inverter current is proportional to the actual lamp power. In particular, the inverter current is substantially equal to the lamp power divided by a DC supply voltage $V_{DC}$ supplied to the inverter circuit. The resistor voltage is filtered by a low-pass filter circuit 114 after which the resistor voltage is supplied to the comparator 118.

In operation, a set power level is via the comparator 118 supplied to the first PI-controller 102 and the VCO 104. The VCO 104 generates a suitable operating frequency signal, which is supplied to the timing generator 106 and the inverter driver circuit 108. In response, the inverter driver circuit 108 generates on/off-switching signals to be supplied to the switching elements S1, S2, which alternately switch conductive and non-conductive at an operating frequency corresponding to the operating frequency signal generated by the VCO 104. Depending on the frequency, an AC lamp current is generated and supplied to the lamp La.

The power consumed by the lamp La is determined using the resistor R1 as an actual lamp power sensing circuit. The determined actual lamp power signal is supplied to the comparator 118. The comparator 118 now supplies a power difference signal indicative of a power difference between the actual lamp power and the set lamp power to the first PI-controller 102. In response to the power difference signal, the PI-controller adjusts the signal provided to the VCO 104, which in response adjusts the operating frequency signal accordingly. Ultimately, the frequency of the AC lamp current is adjusted by the inverter circuit, due to which the actual lamp power changes, as illustrated in FIG. 2A. Thus, the actual lamp power is controlled to become substantially equal to the set lamp power.

Referring to FIG. 2A again, due to EMI regulations, the AC current frequency may be required to lie within a specified range, in particular to lie within a range of 2.2-3.0 MHz. From FIG. 2A it is apparent that consequently the actual lamp power control range is limited, in particular in a corresponding range of about 50—about 85 W. Such a control range is not large enough, in particular it is not large enough for suitable control during the run-up phase of the discharge lamp, since a power boost of at least 50% may be required during run-up.

Figure 4:
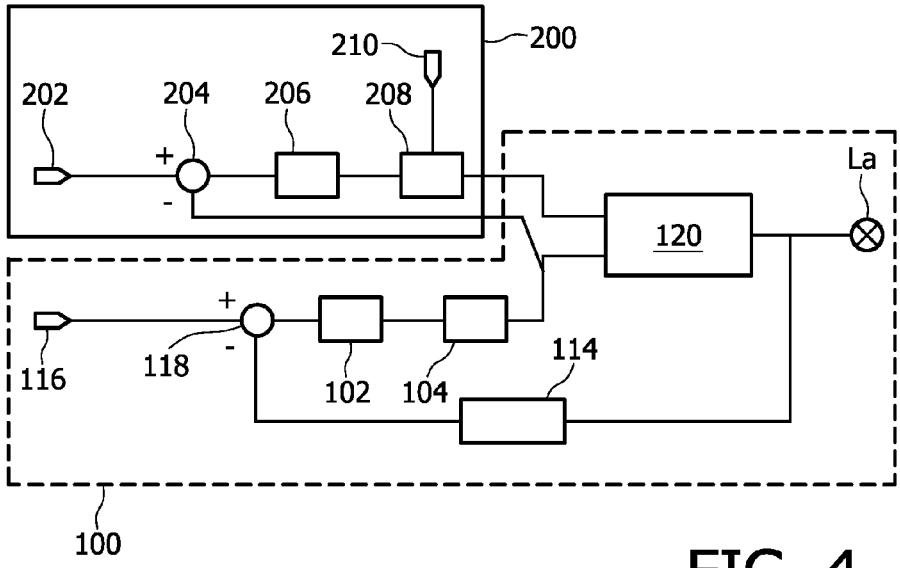
FIG. 4 schematically shows an embodiment of a lamp driver circuit according to the present invention.

In order to achieve a suitable power control range a relatively slow, i.e. low-speed feedback loop is added as illustrated in FIG. 4. In the embodiment of FIG. 4, the high-speed feedback circuit 100 is further provided with a low-speed feedback circuit 200. In FIG. 4, the elements of the high-speed feedback circuit are the power setting element 116, the comparator 118, the first PI-controller 102, the VCO 104 and the low-pass filter 114. The timing generator, the inverter driver circuit, the inverter circuit, the inductor and the capacitor are illustrated as a single driver circuit element 120.

The low-speed feedback circuit 200 comprises a frequency setting element 202 and a comparator 204. The frequency setting element 202 supplies a set frequency signal to the comparator 204 in response to a set frequency, i.e. a predetermined or user-selected lamp current frequency. The comparator 202 is further connected to an output of the VCO 104 for receiving the operating frequency signal indicative of the actual operating frequency. The comparator 202 outputs a frequency difference signal indicative of a difference between the set frequency and the operating frequency. The difference is supplied to a second PI-controller 206. The output of the second PI-controller 206 is supplied to a DC supply voltage generator 208. The DC supply voltage generator 208 is further supplied with an AC supply voltage, e.g. a mains voltage. However, the DC supply voltage generator 208 may as well be supplied with another DC voltage and convert the DC voltage to a suitable DC supply voltage corresponding to the output of the second PI-controller 206. The generated DC supply voltage is supplied to the lamp driver circuit element 120 for generating the AC lamp current.

Figure 5:
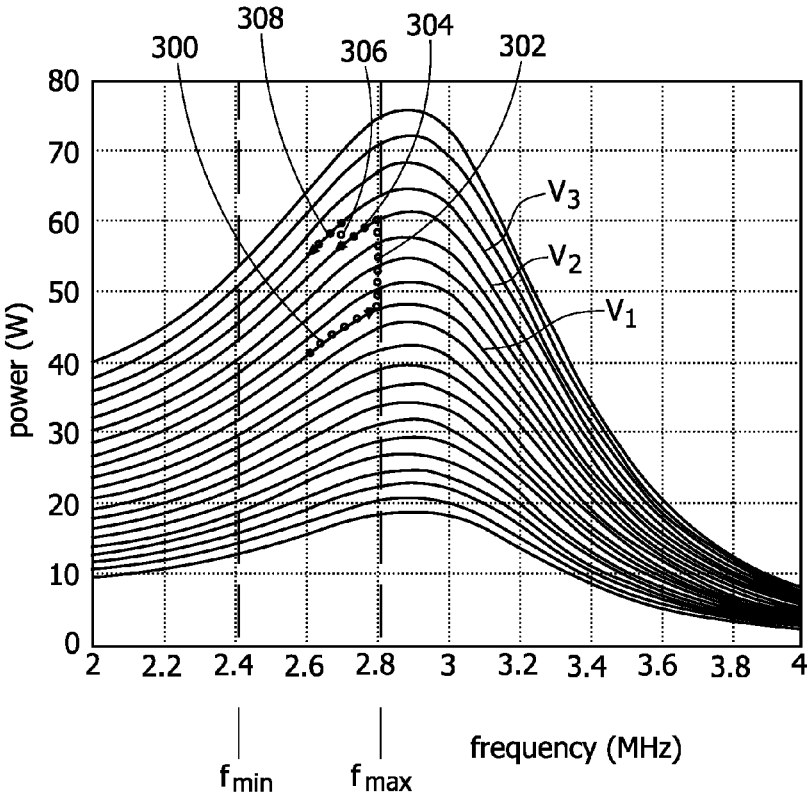
FIG. 5 shows a diagram illustrating a relation between a lamp current frequency, a lamp power and a DC supply voltage.

The operation of the lamp driver circuit as illustrated in FIG. 4 is elucidated with reference to FIG. 5. FIG. 5 illustrates the lamp current frequency—lamp power relation as illustrated in FIG. 2A. In FIG. 5, a number of curves is shown. Each curve represents a DC supply voltage level. Further, a minimum frequency $f_{min}$ and a maximum frequency $f_{max}$ is indicated. The minimum frequency $f_{min}$ and the maximum frequency $f_{max}$ are selected in accordance with EMI regulations. The minimum frequency $f_{min}$ is selected to be 2.4 MHz and the maximum frequency $f_{max}$ is selected to be 2.8 MHz. Further, a set frequency is selected to be 2.6 MHz. It is noted that these frequencies may be selected differently as will be apparent to those skilled in the art.

In FIG. 5, the lamp is assumed to be operated in a steady state mode. For example, the lamp initially operates at the desired 2.6 MHz and at about 42 W. The DC supply voltage is then equal to the voltage level $V_1$.

Now referring to FIG. 4 and FIG. 5, if the set power is then increased, e.g. to 55 W, a difference between the set power and the actual power occurs and a corresponding signal is generated by the comparator 118. Correspondingly, the VCO 104 increases the operating frequency upto the maximum frequency $f_{max}$, i.e. 2.8 MHz, as indicated by arrow 300. Since the operating frequency now deviates from the set frequency of 2.6 MHz, the comparator 204 supplies a corresponding signal to the second PI-controller 206 and the DC supply voltage circuit 208 resulting in an increase of the DC supply voltage from voltage level $V_1$ to eventually a voltage level $V_2$ as indicated by arrow 302. As the actual power (60 W) is then above the set power (55 W) the VCO 104 lowers the operating frequency until the actual power equals the set power of 55 W as indicated by arrow 304. However, since the operating frequency (about 2.7 MHz) is then still higher than the set frequency (2.6 MHz) the DC supply voltage is further increased to a voltage level $V_3$ as indicated by arrow 306. Due to the resulting increase of the actual power, the high-speed feedback circuit then again lowers the operating frequency as indicated by arrow 308, thereby arriving at the desired setting of an actual lamp power of 55 W at an AC lamp current of 2.6 MHz.

It is noted that the maximum frequency $f_{max}$ is selected lower than a maximum power frequency, i.e. the frequency providing the maximum power (in FIG. 5, f=about 2.9 MHz). Due to e.g. manufacturing tolerances and variations in the maximum power frequency, it might be that the operating frequency may be controlled to be higher than the actual maximum power frequency. In such a case, as is apparent from FIGS. 2A and 5, the control loop may become unstable as the lamp power will not increase, but will decrease with increasing operating frequency. Thus, the control loop would switch polarity and shift 180° and become unstable.

Figure 6:
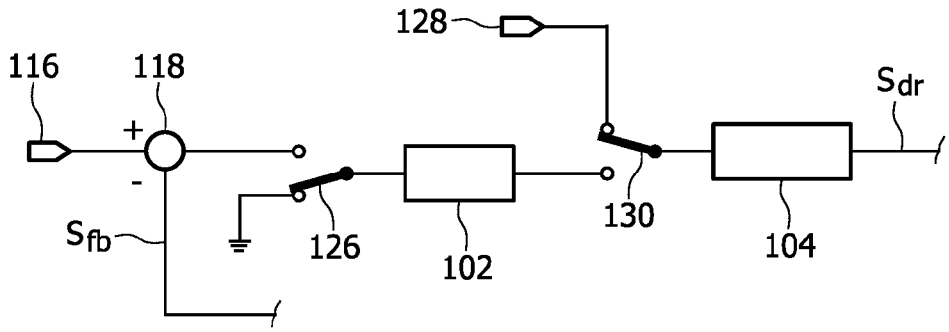
FIG. 6 schematically shows a part of a high-speed feedback circuit for use in a lamp driver circuit according to the present invention.

FIG. 6 illustrates a part of a high-speed feedback circuit for use in a lamp driver circuit according to the present invention. In particular, FIG. 6 illustrates the circuit part comprising the power setting element 116, the comparator 118, the first PI-controller 102 and the VCO 104. Further, a first switch 126 is connected between the comparator 118, first PI-controller 102, and a ground terminal. A second switch 130 is connected between the first PI-controller 102, the VCO 104 and an ignition setting element 128. The ignition setting element 128 is configured to supply a frequency control signal to the VCO 104 instead of the first PI-controller 102. Thereto, an input of the first PI-controller 102 is coupled to ground by suitably switching the first switch 126. An input of the VCO 104 is coupled to the ignition setting element 128 by suitably switching the second switch 130.

The output of the VCO 104 is coupled to a suitable driver circuit for supplying a driver signal Sdr, i.e. an operating frequency signal. A feedback signal Sfb, i.e. an actual lamp power signal, is supplied to the comparator 118, as explained in relation to FIG. 3.

Figure 7:
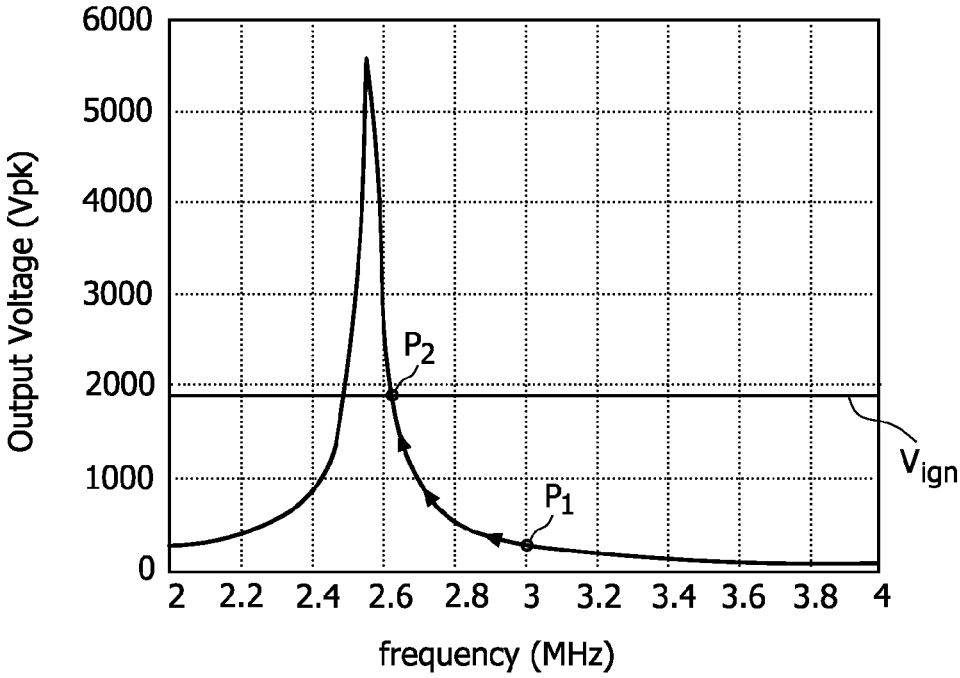
FIG. 7 shows a diagram illustrating a relation between a lamp current frequency and a lamp voltage during ignition.

As illustrated in FIG. 7, for igniting the discharge lamp, a suitably high voltage is to be supplied to the discharge lamp. In FIG. 7, at the horizontal axis, the operating frequency (MHz) is shown. Along the vertical axis, the resulting output voltage (peak voltage) is shown. The output voltage is the voltage over the lamp terminals, i.e. a lamp voltage. For generating a suitably high voltage, a relatively high operating frequency, e.g. 3 MHz ($P_1$ in FIG. 7), is selected as a starting frequency and a resulting lamp voltage is sensed. A signal representing the lamp voltage is then supplied to a control unit. If the sensed lamp voltage is below a predetermined ignition voltage $V_{ign}$ the frequency is lowered by the control unit through the ignition setting element 128. Due to a resonance in the lamp driving circuit (including the discharge lamp) the lamp voltage increases with a decreasing operating frequency until the lamp voltage equals the ignition voltage $V_{ign}$ ($P_2$ in FIG. 7).

After ignition, the first switch 126 and the second switch 130 are switched such that the first PI-controller 102 is coupled between the comparator 118 and the VCO 104. Thus, the circuit as illustrated in FIG. 3 is established for steady-state operation control.

Figure 8:
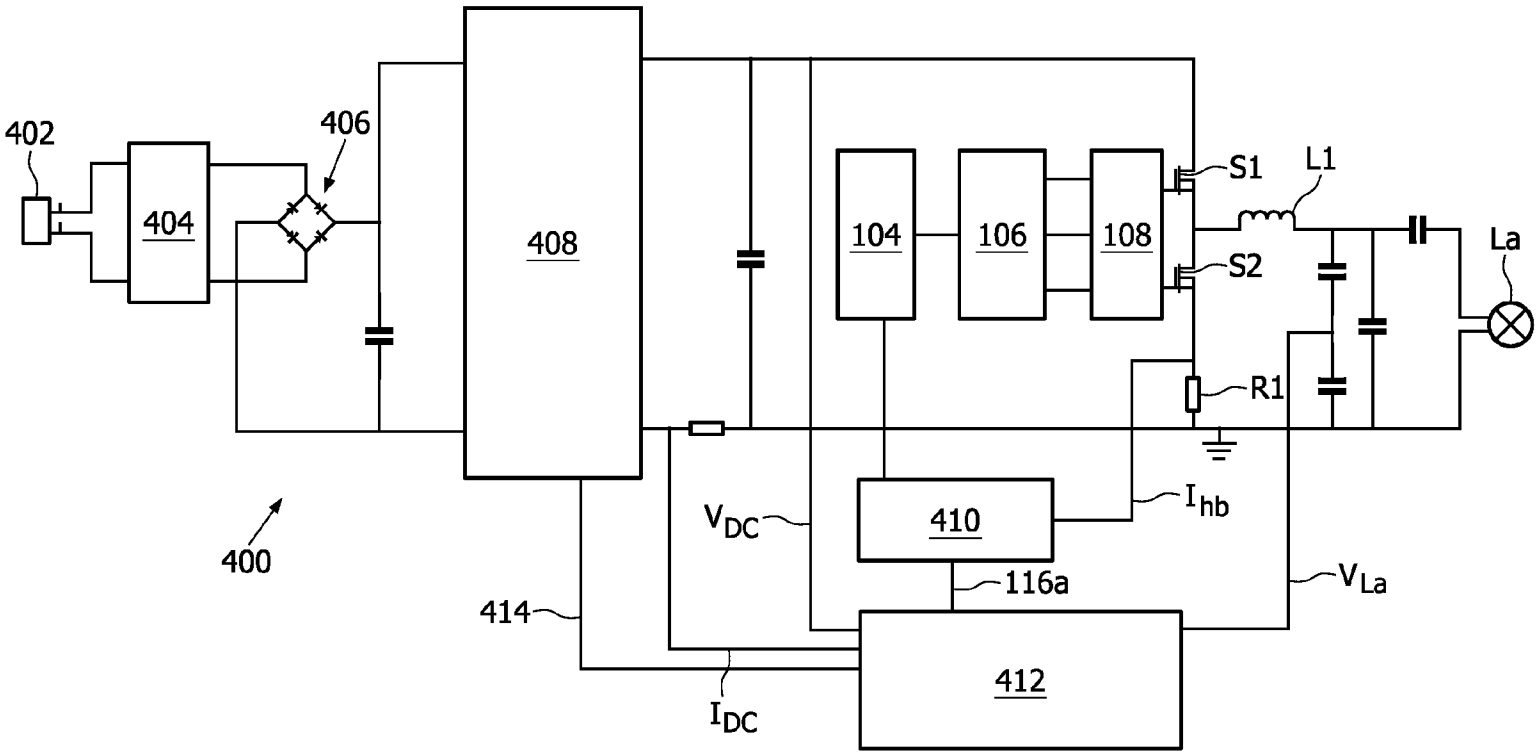
FIG. 8 schematically illustrates an embodiment of a lamp driver circuit according to the present invention.

FIG. 8 illustrates an embodiment of a lamp driver circuit 400 according to the present invention and including similar circuitry as presented in FIG. 4 and FIG. 6. A voltage supply 402 supplies an alternating voltage such as a mains voltage, for example. An EMI filter circuit 404 and a rectifier circuit 406, e.g. a diode bridge rectifier circuit, generate a suitable DC voltage, which is supplied to a DC/DC voltage converter circuit 408. A DC/DC converter voltage $V_{DC}$ output by the DC/DC converter circuit 408 is supplied to a half-bridge inverter circuit comprising the switching elements S1 and S2. The inverter circuit operates together with, inter alia, the inductor L1 to generate a suitable lamp current for operating the lamp La.

A half-bridge current $I_{hb}$, representative for an actual lamp power, is sensed using the resistor R1, as explained in relation to FIG. 3, and a resulting lamp voltage $V_{La}$ is sensed, e.g. for use during an ignition phase. Further, the DC/DC converter voltage $V_{DC}$ and a signal representative of a DC/DC converter current $I_{DC}$ output by the DC/DC converter circuit 408 are sensed. The resulting lamp voltage $V_{La}$, the DC/DC converter voltage $V_{DC}$ and the corresponding DC/DC converter current $I_{DC}$ are supplied to a control unit 412, such as a suitably programmed micro-controller. The control unit 412 operates as a power setting element generating a power setting signal 116*a*. The power setting signal 116*a* and the half-bridge current $I_{hb}$ are supplied to a feedback circuit part 410, for example comprising a comparator and a PI-controller in accordance with the comparator 118 and the first PI-controller 102 as illustrated in FIG. 3. The feedback circuit part 410 supplies a VCO control signal to the VCO 104, which in turn controls the inverter driver circuitry comprising the timing generator 106 and the inverter driver circuit 108 for driving the switching elements S1 and S2.

The control unit 412 is further coupled to the DC/DC converter circuit 408 for supplying a DC voltage control signal 414 in order to control the DC/DC converter circuit 408 to adjust the DC/DC converter voltage $V_{DC}$ if needed, as explained in relation to FIG. 4 and FIG. 5.

The lamp driver circuit 400 is suitable to ignite the discharge lamp La as described in relation to FIG. 6. Referring to FIG. 6 and FIG. 8, the function of the ignition setting element 128 is included in the control unit 412; the first switch 126 and the second switch 130 are included in the feedback circuit part 410. Thus, for a detailed description of an operation for igniting the lamp La reference is made to FIG. 6 and the corresponding description.

The lamp driver circuit 400 comprises the high-speed feedback circuit and the low-speed feedback circuit as illustrated in and described in relation to FIG. 4. Referring to FIG. 4 and FIG. 8, the low-speed feedback circuit 200 is incorporated in the control unit 412. The elements of the high-speed feedback circuit are above identified. Therefore, for a detailed description of an operation for operating the lamp La in steady-state reference is made to FIG. 4 and the corresponding description.

Although detailed embodiments of the present invention are disclosed herein, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the mere fact that certain measures are recited in mutually different dependent claims does not indicate that a combination of these measures cannot be used to advantage.

Further, the terms and phrases used herein are not intended to be limiting; but rather, to provide an understandable description of the invention. The terms "a" or "an", as used herein, are defined as one or more than one. The term another, as used herein, is defined as at least a second or more. The terms including and/or having, as used herein, are defined as comprising (i.e., open language). The term coupled, as used herein, is defined as connected, although not necessarily directly, and not necessarily by means of wires.

The invention claimed is:

1. Lamp driver circuit (400) for operating a discharge lamp (La) at a set lamp power, the lamp driver circuit comprising:

a DC supply voltage circuit (408) for generating a DC supply voltage ($V_{DC}$);

an output circuit for supplying an AC current to the discharge lamp (La), the output circuit comprising an inverter circuit for generating an AC current at an operating frequency from the DC supply voltage;

a feedback circuit comprising:

an actual lamp power sensing circuit for determining an actual lamp power;

a high-speed feedback circuit coupled to the inverter circuit for controlling the operating frequency of the AC current in response to a power difference between the determined actual lamp power and the set lamp power in order to maintain stable lamp operation; and a low-speed feedback circuit coupled to the DC supply voltage circuit for controlling the DC supply voltage in response to the power difference between the determined actual lamp power and the set lamp power in order to control the actual lamp power.

2. Lamp driver circuit according to claim 1, wherein the actual lamp power sensing circuit comprises a resistor (R1) in series coupled to the inverter circuit for determining an inverter current flowing through the inverter circuit, the inverter current being substantially equal to the actual lamp power divided by the DC supply voltage.

3. Lamp driver circuit according to claim 1, wherein the high-speed feedback circuit comprises a voltage controlled oscillator, VCO (104), configured to receive a voltage signal representing the power difference in order to convert the power difference in a suitable operating frequency.

4. Lamp driver circuit according to claim 3, wherein the inverter circuit comprises at least two switching elements (S1, S2) in a bridged topology, the lamp driver circuit further comprising an inverter driver circuit (106, 108) for controlling switching of the switching elements, the inverter driver circuit being coupled to an output of the VCO.

5. Lamp driver circuit according to claim 4, wherein the low-speed feedback circuit is:

configured to receive a set frequency;

coupled to an output of the VCO for receiving the operating frequency; and configured to control the DC supply voltage in response to a frequency difference between the operating frequency and the set frequency, the high-speed feedback circuit being configured to, in response, adjust the operating frequency towards the set frequency.

6. Lamp driver circuit according to claim 1, wherein the low-speed feedback circuit is configured to receive a set frequency, to determine the operating frequency and to control the DC supply voltage in response to a difference between the operating frequency and the set frequency, the high-speed feedback circuit being configured to, in response, adjust the operating frequency towards the set frequency.

7. Method for operating a discharge lamp at a set lamp power, the method comprising:

generating a DC voltage;

generating an AC current at an operating frequency from the DC voltage;

supplying an AC current to the discharge lamp;

determining an actual lamp power;

controlling the frequency of the AC current in response to a difference between the determined actual lamp power and the set lamp power in order to maintain stable operation; and controlling the DC voltage in response to the determined actual lamp power and the set lamp power in order to control the actual lamp power.

8. Method according to claim 7, wherein the DC voltage is controlled in response to a difference between the operating frequency and a predetermined frequency.

* * * * *